US011815926B1

(12) United States Patent
Zlotnik et al.

(10) Patent No.: US 11,815,926 B1
(45) Date of Patent: Nov. 14, 2023

(54) VOLTAGE MANAGEMENT SYSTEM

(71) Applicant: Micron Technology, Inc., Boise, ID (US)

(72) Inventors: Leon Zlotnik, Camino, CA (US); Leonid Minz, Beer Sheva (IL); Ekram H. Bhuiyan, Sunnyvale, CA (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 17/887,333

(22) Filed: Aug. 12, 2022

(51) Int. Cl.
*G05F 1/46* (2006.01)
*G05F 1/575* (2006.01)
*G05F 1/565* (2006.01)

(52) U.S. Cl.
CPC ..... *G05F 1/575* (2013.01); *G05F 1/565* (2013.01)

(58) Field of Classification Search
None
See application file for complete search history.

(56) References Cited

U.S. PATENT DOCUMENTS 3,430,070 A 2/1969 Marshall, Jr. et al.
5,179,295 A 1/1993 Mattison et al.
5,448,155 A * 9/1995 Jutras ..... G05F 1/565 363/79
5,767,717 A 6/1998 Schorn et al.
7,289,921 B1 * 10/2007 Salmi ..... G06F 1/08 702/65
7,818,590 B2 * 10/2010 Yang ..... G11C 5/14 713/340
7,921,312 B1 * 4/2011 Pennanen ..... G06F 1/3296 713/340
8,499,230 B2 * 7/2013 Chakravarty .... G01R 31/31725 714/814
9,599,672 B2 3/2017 Abhishek et al.
2006/0294282 A1 12/2006 Warner
2007/0271473 A1 * 11/2007 Hosomi ..... G06F 1/3203 713/300
2015/0357815 A1 * 12/2015 Luh ..... G06F 1/26 307/31

* cited by examiner

*Primary Examiner* — Thomas J. Hiltunen
(74) *Attorney, Agent, or Firm* — Brooks, Cameron & Huebsch, PLLC

(57) ABSTRACT

A method includes receiving a respective signal from each of a plurality of respective sensor circuits, wherein each respective signal is indicative of a voltage or a current detected by each of the plurality of respective sensor circuits and performing an operation to determine whether one or more of the received signals meets a criterion. The method further includes generating a voltage management control signal in response to a determination that the one or more of the received signals meets the criterion, transferring the voltage management control signal to a voltage regulator, and generating, by the voltage regulator, a voltage signal in response to receipt of the voltage management control signal.

20 Claims, 5 Drawing Sheets

VOLTAGE MANAGEMENT SYSTEM

TECHNICAL FIELD

Embodiments of the disclosure relate generally to digital logic circuits, and more specifically, relate to a voltage management system.

BACKGROUND

A memory sub-system can include one or more memory devices that store data. The memory devices can be, for example, non-volatile memory devices and volatile memory devices. In general, a host system can utilize a memory sub-system to store data at the memory devices and to retrieve data from the memory devices.

BRIEF DESCRIPTION OF THE DRAWINGS

The present disclosure will be understood more fully from the detailed description given below and from the accompanying drawings of various embodiments of the disclosure.

DETAILED DESCRIPTION

Figure 1:
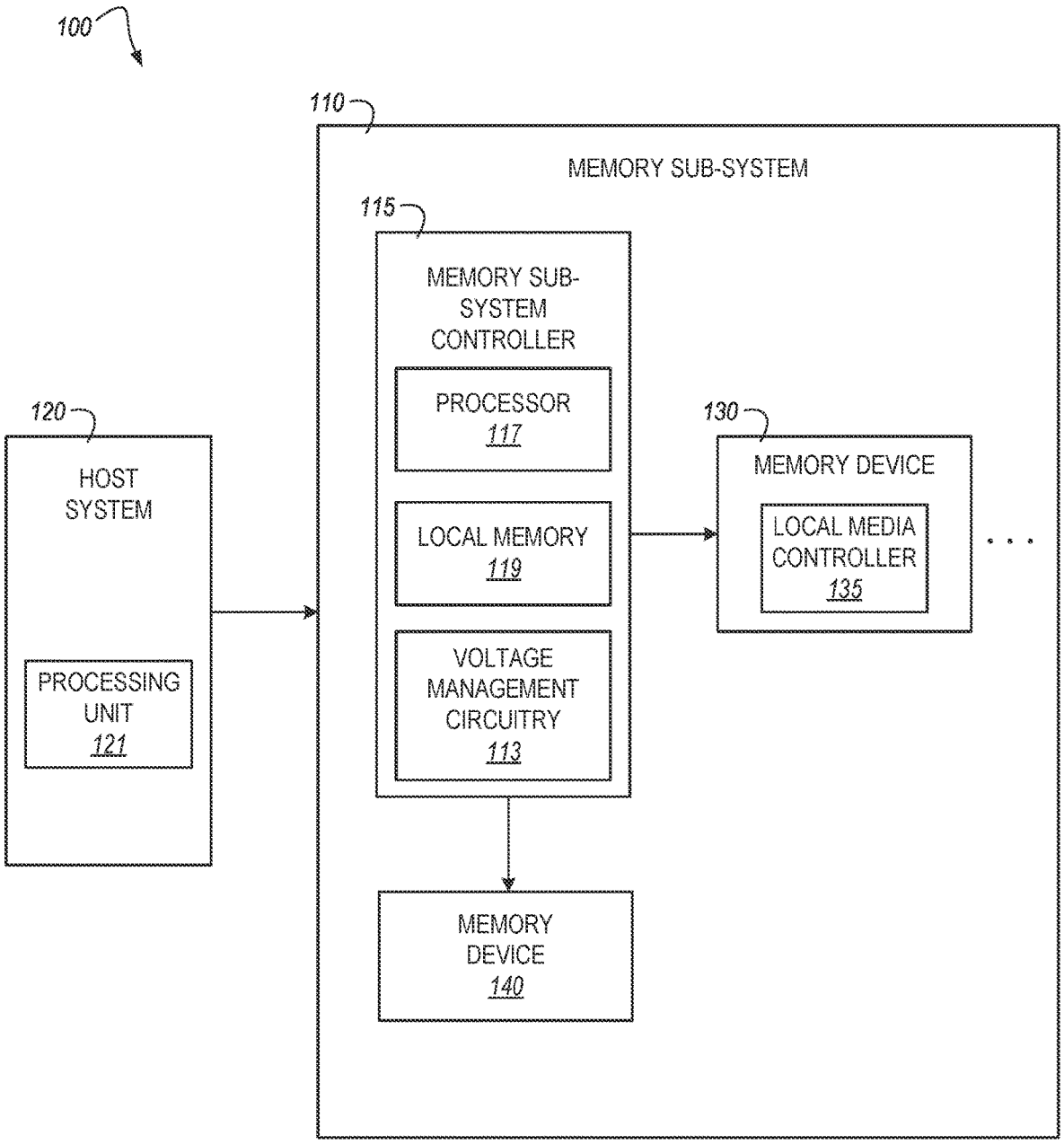
FIG. 1 illustrates an example computing system that includes a memory sub-system in accordance with some embodiments of the present disclosure.

Aspects of the present disclosure are directed to a voltage management system and, in particular, to memory sub-systems that include a voltage management system. A memory sub-system can be a storage system, storage device, a memory module, or a combination of such. An example of a memory sub-system is a storage system such as a solid-state drive (SSD). Examples of storage devices and memory modules are described below in conjunction with FIG. 1, et alibi. In general, a host system can utilize a memory sub-system that includes one or more components, such as memory devices that store data. The host system can provide data to be stored at the memory sub-system and can request data to be retrieved from the memory sub-system.

Power in such memory sub-systems can be provided by various power supplies, which generally supply a voltage signal or current signal to one or more voltage regulators. The voltage regulator(s) then seek to maintain a stable output voltage and provide the stable output voltage to various components of the memory sub-system. Generally, the voltage regulator(s) are able to maintain and provide the stable output voltage under normal operating conditions of the memory sub-system; however, due to various factors such as process variation in components of the memory sub-system, operational conditions of the memory sub-system, and/or sudden changes in loads experienced by components during operation of the memory sub-system, among other factors, the voltage regulator(s) can sometimes temporarily fail to supply a stable voltage to components of the memory sub-system.

For example, a voltage drop (e.g., IR drop) can occur as a voltage signal traverses signal paths in a memory sub-system. In some instances, the voltage drop can lead to scenarios in which a voltage regulator is unable to provide an accurate stable voltage to one or more components of the memory sub-system. In order to remedy such scenarios, some conventional approaches may increase the size of the voltage regulator(s) to utilize larger, more powerful voltage regulators to supply higher than theoretically necessary voltages across a signal path to ensure that adequate voltage is provided to the components of the memory sub-system. However, increasing the power output of the voltage regulator can be costly in terms of power consumption in the memory sub-system, heat generation in the memory sub-system, and/or space (e.g., real estate) consumed in the memory sub-system. These issues can be further exacerbated in certain form factor memory sub-systems, particularly as memory sub-system development trends toward smaller devices that feature densely packed components.

In order to address these and other deficiencies of current approaches, embodiments of the present disclosure provide voltage management circuitry that receives information from various voltage sensors and/or current sensors in the memory sub-system and sends signals to the voltage regulator to cause the voltage regulator to output a modified voltage. As used herein, a "modified voltage" generally refers to a voltage signal (e.g., generated by the voltage regulator) that provides a different voltage level than a voltage signal generated prior to processing of signals from the voltage management circuitry. For example, if the voltage regulator is generating an initial voltage signal that corresponds to X volts during normal operation and the voltage regulator receives the signals from the voltage management circuitry indicating that the voltage regulator is to generate a voltage signal that corresponds to Y volts, the modified voltage can be the voltage Y.

The modified voltage can be greater than the initial voltage (e.g., $Y>X$) or the modified voltage can be less than the initial voltage (e.g., $Y<X$). For example, to remediate a detected voltage overshoot (e.g., a situation in which too great of a voltage is supplied to the memory sub-system), the modified voltage can be less than the initial voltage. Similarly, to remediate a voltage undershoot (e.g., a situation in which too small of a voltage is supplied to the memory sub-system), the modified voltage can be less than the initial voltage.

In some embodiments, the voltage management circuitry can determine, based on the information received from various voltage sensors and/or current sensors in the memory sub-system, a "worst" voltage drop or IR drop in the memory sub-system and send signals to the voltage regulator corresponding to this "worst" voltage drop or IR drop. As used herein, a "worst voltage drop" or a "worst IR drop" generally refers to a voltage or a current (or a change in a voltage or current) measured by the voltage sensors and/or the current sensors that has a lowest voltage or a highest current (or largest change in voltage or largest change in current) as compared to other voltages and/or currents measured by the other voltage sensors and/or the other current sensors. As an example, consider that a first voltage sensor measures a voltage of 0.78 volts for a first portion of the memory sub-system, a second voltage sensor measures a voltage of 0.75 volts for a second portion of the memory sub-system, and a third voltage sensor measures a voltage of 0.80 volts for a third portion of the memory sub-system.

In this non-limiting example, the voltage management circuitry determines that the voltage 0.75 is the "worst voltage drop." In response to this determination, the voltage management circuitry can send signals to the voltage regulator to cause the voltage regulator to output a modified voltage that compensates for the worst voltage drop. That is, the voltage management circuitry can signal to the voltage regulator that an additional amount of voltage is required in the memory sub-system to compensate for the detected worst voltage drop and the voltage regulator can output a modified voltage that accounts for this "worst voltage drop."

By providing voltage compensation only as needed (e.g., in response to signaling generated by the voltage management circuitry based on the information received from the various voltage sensors and/or the various current sensors) to provide a voltage boost (or reduction) or a current boost (or reduction) to components of the memory sub-system in accordance with the disclosure, power savings (e.g., a reduction in power consumed by the memory sub-system) are realized in comparison to the approaches described above, thereby yielding an improvement to the memory sub-system. In addition, heat generation in the memory sub-system is reduced in comparison to the approaches described above thereby reducing the quantity and/or size of thermal dissipation components in the memory sub-system thereby yielding further improvements to the memory sub-system. Further, overall performance of a memory sub-system which employs aspects of the disclosure is improved without the need for increased power consumption in contrast to previous approaches.

FIG. 1 illustrates an example computing system 100 that includes a memory sub-system 110 in accordance with some embodiments of the present disclosure. The memory sub-system 110 can include media, such as one or more volatile memory devices (e.g., memory device 140), one or more non-volatile memory devices (e.g., memory device 130), or a combination of such.

A memory sub-system 110 can be a storage device, a memory module, or a hybrid of a storage device and memory module. Examples of a storage device include a solid-state drive (SSD), a flash drive, a universal serial bus (USB) flash drive, an embedded Multi-Media Controller (eMMC) drive, a Universal Flash Storage (UFS) drive, a secure digital (SD) card, and a hard disk drive (HDD). Examples of memory modules include a dual in-line memory module (DIMM), a small outline DIMM (SO-DIMM), and various types of non-volatile dual in-line memory modules (NVDIMMs).

The computing system 100 can be a computing device such as a desktop computer, laptop computer, server, network server, mobile device, a vehicle (e.g., airplane, drone, train, automobile, or other conveyance), Internet of Things (IoT) enabled device, embedded computer (e.g., one included in a vehicle, industrial equipment, or a networked commercial device), or such computing device that includes memory and a processing device.

In other embodiments, the voltage sensing circuit 100 can be deployed on, or otherwise included in a computing device such as a desktop computer, laptop computer, server, network server, mobile computing device, a vehicle (e.g., airplane, drone, train, automobile, or other conveyance), Internet of Things (IoT) enabled device, embedded computer (e.g., one included in a vehicle, industrial equipment, or a networked commercial device), or such computing device that includes memory and a processing device. As used herein, the term "mobile computing device" generally refers to a handheld computing device that has a slate or phablet form factor. In general, a slate form factor can include a display screen that is between approximately 3 inches and 5.2 inches (measured diagonally), while a phablet form factor can include a display screen that is between approximately 5.2 inches and 7 inches (measured diagonally). Examples of "mobile computing devices" are not so limited, however, and in some embodiments, a "mobile computing device" can refer to an IoT device, among other types of edge computing devices.

The computing system 100 can include a host system 120 that is coupled to one or more memory sub-systems 110. In some embodiments, the host system 120 is coupled to different types of memory sub-system 110. FIG. 1 illustrates one example of a host system 120 coupled to one memory sub-system 110. As used herein, "coupled to" or "coupled with" generally refers to a connection between components, which can be an indirect communicative connection or direct communicative connection (e.g., without intervening components), whether wired or wireless, including connections such as electrical, optical, magnetic, and the like.

The host system 120 can include a processor chipset and a software stack executed by the processor chipset. The processor chipset can include one or more cores, one or more caches, a memory controller (e.g., an SSD controller), and a storage protocol controller (e.g., PCIe controller, SATA controller). The host system 120 uses the memory sub-system 110, for example, to write data to the memory sub-system 110 and read data from the memory sub-system 110.

The host system 120 includes a processing unit 121. The processing unit 121 can be a central processing unit (CPU) that is configured to execute an operating system. In some embodiments, the processing unit 121 comprises a complex instruction set computer architecture, such an x86 or other architecture suitable for use as a CPU for a host system 120.

The host system 120 can be coupled to the memory sub-system 110 via a physical host interface. Examples of a physical host interface include, but are not limited to, a serial advanced technology attachment (SATA) interface, a peripheral component interconnect express (PCIe) interface, universal serial bus (USB) interface, Fibre Channel, Serial Attached SCSI (SAS), Small Computer System Interface (SCSI), a double data rate (DDR) memory bus, a dual in-line memory module (DIMM) interface (e.g., DIMM socket interface that supports Double Data Rate (DDR)), Open NAND Flash Interface (ONFI), Double Data Rate (DDR), Low Power Double Data Rate (LPDDR), or any other interface. The physical host interface can be used to transmit data between the host system 120 and the memory sub-system 110. The host system 120 can further utilize an NVM Express (NVMe) interface to access components (e.g., memory devices 130) when the memory sub-system 110 is coupled with the host system 120 by the PCIe interface. The physical host interface can provide an interface for passing control, address, data, and other signals between the memory sub-system 110 and the host system 120. FIG. 1 illustrates a memory sub-system 110 as an example. In general, the host system 120 can access multiple memory sub-systems via the same communication connection, multiple separate communication connections, and/or a combination of communication connections.

The memory devices 130, 140 can include any combination of the different types of non-volatile memory devices and/or volatile memory devices. The volatile memory devices (e.g., memory device 140) can be, but are not limited to, random access memory (RAM), such as dynamic random-access memory (DRAM) and synchronous dynamic random access memory (SDRAM).

Some examples of non-volatile memory devices (e.g., memory device 130) include negative-and (NAND) type flash memory and write-in-place memory, such as three-dimensional cross-point ("3D cross-point") memory device, which is a cross-point array of non-volatile memory cells. A cross-point array of non-volatile memory can perform bit storage based on a change of bulk resistance, in conjunction with a stackable cross-gridded data access array. Additionally, in contrast to many flash-based memories, cross-point non-volatile memory can perform a write in-place operation, where a non-volatile memory cell can be programmed without the non-volatile memory cell being previously erased. NAND type flash memory includes, for example, two-dimensional NAND (2D NAND) and three-dimensional NAND (3D NAND).

Each of the memory devices 130, 140 can include one or more arrays of memory cells. One type of memory cell, for example, single level cells (SLC) can store one bit per cell. Other types of memory cells, such as multi-level cells (MLCs), triple level cells (TLCs), quad-level cells (QLCs), and penta-level cells (PLC) can store multiple bits per cell. In some embodiments, each of the memory devices 130 can include one or more arrays of memory cells such as SLCs, MLCs, TLCs, QLCs, or any combination of such. In some embodiments, a particular memory device can include an SLC portion, and an MLC portion, a TLC portion, a QLC portion, or a PLC portion of memory cells. The memory cells of the memory devices 130 can be grouped as pages that can refer to a logical unit of the memory device used to store data. With some types of memory (e.g., NAND), pages can be grouped to form blocks.

Although non-volatile memory components such as three-dimensional cross-point arrays of non-volatile memory cells and NAND type memory (e.g., 2D NAND, 3D NAND) are described, the memory device 130 can be based on any other type of non-volatile memory or storage device, such as such as, read-only memory (ROM), phase change memory (PCM), self-selecting memory, other chalcogenide based memories, ferroelectric transistor random-access memory (FeTRAM), ferroelectric random access memory (FeRAM), magneto random access memory (MRAM), Spin Transfer Torque (STT)-MRAM, conductive bridging RAM (CBRAM), resistive random access memory (RRAM), oxide based RRAM (OxRAM), negative-or (NOR) flash memory, and electrically erasable programmable read-only memory (EEPROM).

The memory sub-system controller 115 (or controller 115 for simplicity) can communicate with the memory devices 130 to perform operations such as reading data, writing data, or erasing data at the memory devices 130 and other such operations. The memory sub-system controller 115 can include hardware such as one or more integrated circuits and/or discrete components, a buffer memory, or a combination thereof. The hardware can include digital circuitry with dedicated (i.e., hard-coded) logic to perform the operations described herein. The memory sub-system controller 115 can be a microcontroller, special purpose logic circuitry (e.g., a field programmable gate array (FPGA), an application specific integrated circuit (ASIC), etc.), or other suitable processor.

The memory sub-system controller 115 can include a processor 117 (e.g., a processing device) configured to execute instructions stored in a local memory 119. In the illustrated example, the local memory 119 of the memory sub-system controller 115 includes an embedded memory configured to store instructions for performing various processes, operations, logic flows, and routines that control operation of the memory sub-system 110, including handling communications between the memory sub-system 110 and the host system 120.

In some embodiments, the local memory 119 can include memory registers storing memory pointers, fetched data, etc. The local memory 119 can also include read-only memory (ROM) for storing micro-code. While the example memory sub-system 110 in FIG. 1 has been illustrated as including the memory sub-system controller 115, in another embodiment of the present disclosure, a memory sub-system 110 does not include a memory sub-system controller 115, and can instead rely upon external control (e.g., provided by an external host, or by a processor or controller separate from the memory sub-system).

In general, the memory sub-system controller 115 can receive commands or operations from the host system 120 and can convert the commands or operations into instructions or appropriate commands to achieve the desired access to the memory device 130 and/or the memory device 140. The memory sub-system controller 115 can be responsible for other operations such as wear leveling operations, garbage collection operations, error detection and error-correcting code (ECC) operations, encryption operations, caching operations, and address translations between a logical address (e.g., logical block address (LBA), namespace) and a physical address (e.g., physical block address, physical media locations, etc.) that are associated with the memory devices 130. The memory sub-system controller 115 can further include host interface circuitry to communicate with the host system 120 via the physical host interface. The host interface circuitry can convert the commands received from the host system into command instructions to access the memory device 130 and/or the memory device 140 as well as convert responses associated with the memory device 130 and/or the memory device 140 into information for the host system 120.

The memory sub-system 110 can also include additional circuitry or components that are not illustrated. In some embodiments, the memory sub-system 110 can include a cache or buffer (e.g., DRAM) and address circuitry (e.g., a row decoder and a column decoder) that can receive an address from the memory sub-system controller 115 and decode the address to access the memory device 130 and/or the memory device 140.

In some embodiments, the memory device 130 includes local media controllers 135 that operate in conjunction with memory sub-system controller 115 to execute operations on one or more memory cells of the memory devices 130. An external controller (e.g., memory sub-system controller 115) can externally manage the memory device 130 (e.g., perform media management operations on the memory device 130). In some embodiments, a memory device 130 is a managed memory device, which is a raw memory device combined with a local controller (e.g., local controller 135) for media management within the same memory device package. An example of a managed memory device is a managed NAND (MNAND) device.

The memory sub-system 110 can include voltage management circuitry 113. Although not shown in FIG. 1 so as to not obfuscate the drawings, the voltage management circuitry 113 can include various circuitry to facilitate aspects of the disclosure described herein. In some embodiments, the voltage management circuitry 113 can include special purpose circuitry in the form of an ASIC, FPGA, state machine, hardware processing device, and/or other logic circuitry that can allow the voltage management circuitry 113 to orchestrate and/or perform operations to provide dynamic voltage compensation, particularly with respect to a system-on-chip, in accordance with the disclosure. In some embodiments, the voltage management circuitry 113 can comprise a portion of voltage regulation circuitry (e.g., the voltage regulation circuitry 255/355 illustrated in FIG. 2 and FIG. 3, herein) that further includes a voltage regulator (e.g., the voltage regulator 252/352 illustrated in FIG. 2 and FIG. 3, herein).

In some embodiments, the memory sub-system controller 115 includes at least a portion of the voltage management circuitry 113. For example, the memory sub-system controller 115 can include a processor 117 (processing device) configured to execute instructions stored in local memory 119 for performing the operations described herein. In some embodiments, the voltage management circuitry 113 is part of the host system 110, an application, or an operating system. The voltage management circuitry 113 can be resident on the memory sub-system 110 and/or the memory sub-system controller 115. As used herein, the term "resident on" refers to something that is physically located on a particular component. For example, the voltage management circuitry 113 being "resident on" the memory sub-system 110, for example, refers to a condition in which the hardware circuitry that comprises the voltage management circuitry 113 is physically located on the memory sub-system 110. The term "resident on" may be used interchangeably with other terms such as "deployed on" or "located on," herein.

Figure 2:
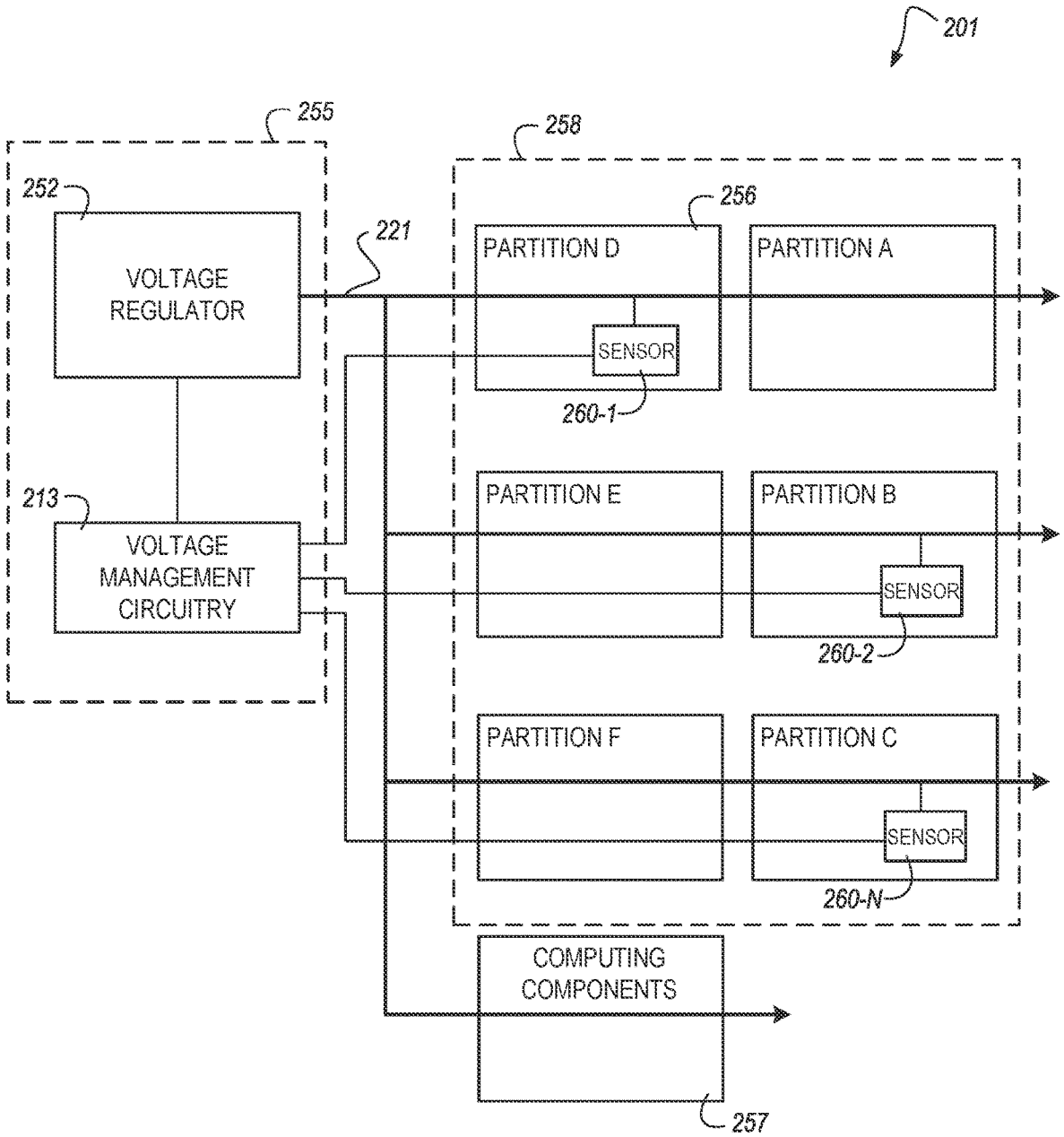
FIG. 2 illustrates an example of a voltage management system in accordance with some embodiments of the present disclosure.

FIG. 2 illustrates an example of a voltage management system 201 in accordance with some embodiments of the present disclosure. The example system 201, which can be referred to in the alternative as an "apparatus," includes voltage regulation circuitry 255, which includes a voltage regulator 252 and voltage management circuitry 213. The voltage regulator 252 is coupled to a voltage signal line 221 (e.g., a rail to provide a power supply signal or "supply voltage signal" to one or more electrical components, such as the circuit portion areas 256 and/or the computing components 257). The voltage signal line 221 can be split into one or more voltage supply lines that supply voltage to the circuit portion areas 256 and the computing components 257 of the system 201.

As the voltage signal generated by the main voltage regulator 252 traverses the voltage signal line 221, the magnitude of the voltage signal can be reduced, e.g., can experience an IR drop and/or a voltage drop. Accordingly, under some conditions, a "global voltage" signal (e.g., the voltage signal on the rail 221 prior to being split into different voltage supply lines) can have a greater magnitude (e.g., correspond to a larger voltage) than a "local voltage" signal (e.g., the voltage signal by the time it reaches the computing components 257). When the magnitude of the voltage signal is decreased, for example due to an IR drop, an increase in a current associated with the voltage signal can be detected using the sensor circuits 260-1, 260-2 to 260-N (generally referred to as "sensors circuits 260"). Conversely, when the magnitude of the voltage signal is increased, a decrease in the current associated with the voltage signal can be detected using the sensor circuits 260. In some embodiments, the sensor circuits 260 can be voltage sensors that are configured to detect voltages and/or changes in voltages in the system 201. Embodiments are not so limited, however, and in some embodiments, the sensor circuits 260 can be current sensors that are configured to detect currents and/or changes in currents in the system 201, among other possibilities are contemplated within the scope of the disclosure.

In FIG. 2, the system 201 includes a circuit area 258 that includes a number of circuit portion areas 256 (e.g., partitions A-F) that have power supplied thereto via the main voltage regulator 252 through voltage supply lines coupled to the voltage supply line 221. The circuit portion areas 256 can be logic blocks that can include various hardware that form one or more cores (e.g., "intellectual property (IP) cores"). As used herein, a "core" or "IP core" generally refers to one or more blocks of data and/or logic that form constituent components of an application-specific integrated circuit or field-programmable gate array. The circuit portion areas can be designed, built, and/or otherwise configured to perform specific tasks and/or functions within the systems described herein. In some embodiments, the main voltage regulator 252 and/or the voltage management circuitry 213 can take an action (or cause an action to be taken) to track, limit, adjust or manipulate the voltage signals applied to the voltage signal line 221 and/or the voltage supply lines coupled to the voltage signal line 221 to provide voltage manipulation to the circuit portion areas 256.

As shown in FIG. 2, the circuit portion areas 256 can include sensor circuits 260. The sensor circuits 260 can include various hardware circuitry and/or circuitry components to detect voltage levels and/or current levels applied to the circuit portion areas 256 and/or the computing components 257 via the voltage signal line 221 and/or the voltage supply lines coupled to the voltage signal line 221. The sensor circuits 260 can be configured to transfer information indicative of a change in the current or the voltage, or both, associated with the voltage signal line 221 and/or the voltage supply lines coupled to the voltage signal line 221 to the voltage management circuitry 213. In response to receipt of such signaling, the voltage management circuitry 213 can control application of voltage signaling from the voltage regulator 252 to regulate a voltage signal applied to the voltage signal line 221.

The sensor circuit(s) 260 described herein include various circuit components (e.g., delay circuits, detector circuits, etc.) that can allow for instantaneous voltages and/or currents within the voltage management system 201 to be determined. The sensor circuits 260 can include a first oscillator circuit (e.g., a free-running oscillator) that is powered from a rail of the voltage regulator 252 (e.g., a rail of a voltage regulator 252 that is local to the voltage management system 201 and/or provides a measured voltage that may or may not be coupled to a main power supply of the voltage management system 201. In such embodiments, the oscillator circuit can serve as a voltage and/or current sensor that is part of the sensor circuit(s) 260. The sensor circuits 260 can further include a second oscillator circuit (e.g., a reference oscillator or delay circuit) that is powered from a separate voltage supply (e.g., a different voltage regulator that provides a stable voltage that is characterized by low noise and/or low voltage fluctuation to the voltage management system 201.

Frequency differences between the oscillator circuits can be compared to determine an instantaneous sense voltage value that corresponds to the actual sensed voltage at a particular moment in time of the voltage management system 201 associated with the sensor circuit(s) 260. In addition, a phase difference between one or more of the oscillator circuits and at least one delay circuit can be compared to determine an instantaneous sense voltage value that corresponds to the actual sensed voltage at a particular moment in time of the voltage management system 201 and/or components thereof. In the case of compared frequencies, a difference in the compared frequencies indicates that oscillators are subjected to differing voltages, while in the case of the phase associated with a signal from the oscillator being compared to the delay circuit, a phase difference may be detected with the oscillator and the delay circuit are subjected to differing voltage. By allowing for instantaneous (or near-instantaneous) voltage sensing and/or current sensing using the sensor circuits 260, electrical signals, such as voltages and/or currents, can be tracked, limited, adjusted, and/or manipulated to dynamically alter power consumption and/or noise in the voltage management system 201 in particular in automated power management systems.

In some embodiments, the sensor circuit(s) 260 (e.g., voltage tracking circuit(s), current tracking circuit(s), etc.) described herein can include various circuit components (e.g., delay lines, phase detectors, control circuits, etc.) that can allow for accurate and timely (e.g., instantaneous or near-instantaneous) detection of voltages, currents, or other signaling associated with a SoC, ASIC, FPGA, or other such hardware circuitry associated with the voltage management system 201 and/or components coupled thereto. The sensor circuit(s) 260 can include multiple delay line blocks that are coupled to a phase detector (PD) delay line block. The PD delay line block can be coupled via taps to phase detection circuitry that can include multiple phase detector circuits (e.g., flip-flops). As used herein, the term "tap" generally refers to a contact point or physical connection between one or more components. The phase detection circuitry can be coupled to a controller (e.g., the voltage management circuitry 213) that can determine an "actual" or measured voltage or associated current present in a system that includes the sensor circuit(s) 260. In some embodiments, the sensor circuit(s) 260 can be used to determine an actual (e.g., measured) voltage or current associated with the SoC, ASIC, FPGA, or other such hardware circuitry.

In some embodiments, the sensor circuit(s) 260 can detect voltages, currents, or other signals based on multiple voltage and/or current measurements. For example, the detected voltages, currents, etc. can be determined using a coarse voltage measurement and a fine voltage measurement, among other possibilities. In embodiments in which a coarse voltage measurement and a fine voltage measurement are used to determine the measured voltage, information delay line blocks can be used to determine the coarse voltage measurement and information from phase detectors can be used to determine the fine voltage measurement, as described in more detail herein.

In addition, embodiments herein allow for a threshold voltage to be set for use by the sensor circuit(s) 260 and/or components coupled thereto. For example, a magnitude of a voltage signal generated by one or more voltage regulators can be set as an actual (e.g., measured) voltage for use by the voltage management circuitry 213 and/or components coupled thereto based on signals received from the sensor circuit 260. By comparing various parameters (e.g., delay line block characteristics, frequencies, phase shifts, etc.) that are determined by the components described herein (e.g., by the sensor circuits 260 and/or the voltage management circuitry 213, it is possible to determine an accurate actual (e.g., measured) operational voltage and use this operational voltage in order to manipulate dynamic power consumption and/or noise in the voltage regulation system 201.

In some embodiments, the voltage management circuitry 213 can determine, based on signals received from the sensor circuits 260, which of the sensor circuits 260 is detecting a worst voltage drop and/or a worst IR drop from the circuit area portions 258 and/or from the computing components 257. Once the voltage management circuitry 213 determines the worst voltage drop and/or the worst IR drop from the circuit area portions 258 and/or from the computing components 257, the voltage management circuitry 213 can transfer one or more signals (e.g., voltage management control signals) to the voltage regulator 252 to cause the voltage regulator 252 to supply a modified voltage signal on the voltage signal line 221. In some embodiments, the voltage management control signals can comprise digital signals that include information indicating an amount of voltage and/or current that is necessary to remediate the detected worst voltage drop and/or the detected worst IR drop, as described in more detail below.

In some embodiments, the voltage regulation system 201 can be configured such that different voltage thresholds, current thresholds, and/or different voltage and/or current amplitudes (e.g., different amounts of gain) can be applied to and detected by different sensor circuits 260. By allowing for different voltage thresholds and/or different current thresholds to be detected by individual sensor circuits the voltage regulation system 201 can provide additional benefits over merely controlling the worst voltage drop and/or worst IR drop. For example, in practice, some of the circuit portion areas 256 and/or some of the computing components 257 may exhibit characteristics that are more tolerant to voltage drops and/or to IR drop than other circuit portion areas 256 and/or some of the computing components 257. In such scenarios, embodiments of the disclosure allow for the components of the voltage regulation system 201 (e.g., the sensors circuits 260, the voltage management circuitry 213, and/or the voltage regulator 252, etc.) can determine and set signals indicative of a higher voltage threshold to comparatively more critical circuit portion areas 256 and/or computing components 257 (e.g., those circuit portion areas 256 and/or some of the computing components 257 that are more prone to errors and/or failures when the voltage signal is greater than or less than expected or greater than expected) and can determine and set signals indicative of a lower voltage threshold to comparatively less critical circuit portion areas 256 and/or computing components 257 (e.g., those circuit portion areas 256 and/or some of the computing components 257 that are less prone to errors and/or failures when the voltage signal is greater than or less than expected or greater than expected).

As an illustrative example, if one or more circuit portion areas 256 and/or computing components 257 have a voltage threshold of 0.77 V and one or more different circuit portion areas 256 and/or computing components 257 have a voltage threshold of 0.75 V, when a voltage level detected by a sensor circuit 260 that is monitoring the comparatively more critical circuit portion areas 256 and/or computing components 257 and a voltage level detected by a sensor circuit 260 that is monitoring the comparatively less critical circuit portion areas 256 and/or computing components 257 both detect a voltage of 0.76 V, the voltage 0.77 V can be considered to be the worst voltage drop and can consequently be reported to the voltage management circuitry 213.

In other embodiments, the voltage regulation system 201 can be configured such that a relative weight of voltage and/or current required by different circuit portion areas 256 and/or different computing components 257 can be considered by the voltage regulation system 201 in providing the benefits of the present disclosure. For example, two circuit portion areas 256 and/or two computing components 257 can have a same targeted voltage (after an inherent IR drop is accounted for) but one of two circuit portion areas 256 and/or two computing components 257 may be more sensitive to effects of the IR drop and/or voltage drop. For instance, scenarios may arise in which both of the two circuit portion areas 256 and/or both of the two computing components 257 require 0.75 V for operation but one of the two circuit portion areas 256 and/or the two computing components 257 can still operate with a voltage of 0.73 V while the other of the two circuit portion areas 256 and/or the two computing components 257 would stop working at 0.74 V. If, in this scenario, the local voltage drops to 0.745 V, the sensor circuits 260 associated with both of the two circuit portion areas 256 and/or both of the two computing components 257 may generate signaling indicative of an "undervoltage" condition (e.g., a condition in which there appears to be too little voltage supplied to maintain operation of the circuit portion areas 256 and/or the computing components 257).

In such instances, the voltage regulation circuitry 201 can determine that a weight (e.g., an amount of gain) corresponding to one of the two circuit portion areas 256 and/or one of the two computing components 257 indicates that this particular one of the two circuit portion areas 256 and/or one of the two computing components 257 should be prioritized for subjection to the voltage management techniques described herein. Stated alternatively, if there is a gain of 2 associated with one of the two circuit portion areas 256 and/or one of the two computing components 257, the 0.75 V−0.745V=0.05V undervoltage may be magnified (e.g., gained) to 0.1 V using the gain factor of 2 (e.g., because the gain in this example is 2 and 0.05 V multiplied by 2 is 0.1 V) and may cause the voltage regulator 252 to provide additional voltage to the voltage signal line 221 (e.g., to overcompensate for the voltage discrepancy). It is noted that an embodiment in which the gain is 2 is merely illustrative and other values for the gain are contemplated by the disclosure. This feature, among other features of the present disclosure can allow for delays in measuring the voltage using the sensor circuits 260 and/or for adjusting the voltage output to provide the modified voltage (e.g., by the voltage regulator 252) to be accounted for, thereby improving the functioning of a computing system in which aspects of the present disclosure are deployed.

More broadly speaking, each of the sensor circuits 260 can have a particular (e.g., voltage and/or current) threshold associated therewith and/or a particular gain threshold associated therewith. Further, each sensor circuit 260 can be configured based on characteristics of the circuit portion area 256 and/or the computing component 257 that the sensor circuit 260 is coupled to and/or monitoring.

As shown in FIG. 2, the voltage management system 201 can be coupled to one or more computing components 257. Although not explicitly shown in FIG. 2, the computing components 257 can include one or more sensor circuits, which can be analogous to the sensor circuits 260. The computing components 257 are generally external to the voltage regulation circuitry 255 (i.e., the computing components are physically distinct from a chip, such a SoC that, at minimum, the voltage regulation circuitry 255 is deployed on) but are communicatively couplable to the voltage regulation circuitry 255 such that signaling can be exchanged between the voltage regulation circuitry 255 and the computing components. Non-limiting examples of the computing components can include controllers, memory devices, graphics processing units, processors/co-processors, and/or logic blocks, among others that are deployed on a memory sub-system (e.g., the memory sub-system 110 illustrated in FIG. 1, herein) in which the voltage management system 201 operates.

In some embodiments, characteristics of the circuit portion areas 256 and/or the computing components 257 coupled to the voltage regulation circuitry 255 can further exacerbate the IR drop an/or voltage drop discussed above. For example, higher than expected currents that can be present due to leaky silicon and/or dynamic peak currents, among other possibilities, can lead to scenarios in which the voltage regulator 252 is unable to consistently provide adequate voltage to the voltage signal line 221. As described above, some conventional approaches may attempt to rectify this by increasing the size, complexity, and/or power available to the voltage regulator 225.

However, as mentioned above, these approaches can be costly in terms of space, power consumption, and/or heat dissipation, among other factors. Further, because it may only be necessary to temporarily boost the voltage to the voltage signal line 221, increasing the size, complexity, and/or power available to the voltage regulator 252 may be unnecessary. Accordingly, aspects of the present disclosure provide voltage management circuitry 213 that is configured to determine, at minimum, a "worst voltage drop" and/or a "worst IR drop" experienced by the circuit portion areas 256 and/or the computing components 257 and provide signaling (e.g., a voltage management control signal) indicative of this "worst voltage drop" and/or a "worst IR drop" to the voltage regulator 252. The voltage regulator 252 can, based on the voltage management control signal, modify a voltage signal applied to the voltage signal line 221 to provide voltage compensation to at least one of the computing components 257 and/or to at least one circuit portion area 256 coupled to the voltage regulator 252.

In addition to, or in the alternative, the voltage regulator 252 and/or the voltage management circuitry 213 can be provided in the voltage management system 201 such that power dissipation characteristics and/or electrical noise generation characteristics of the voltage regulator 252 and/or the voltage management circuitry 213 are at least marginally optimized for the voltage management system 201. For example, if a comparatively more powerful voltage regulator 252 (e.g., in terms of physical size, power output, etc.) is deployed in the voltage management system 201, characteristics of the voltage management circuitry 213 may be chosen such that the voltage management circuitry 213 is only activated (e.g., only supplies a voltage management control signal) to control peak power dissipation associated with the voltage regulator 252. As another example, characteristics of the voltage management circuitry 213 may be chosen such that the voltage management circuitry 213 operates at a relatively low noise level in scenarios in which noise concerns in the voltage management system 201 may be important. In any event, by providing the voltage management circuitry 213 in a manner consistent with desired parameters (e.g., peak power dissipation, noise generation, physical size, thermal dissipation, reaction time to voltage or current overshoots or undershoots, etc.) of the voltage management system 201 in which the voltage management circuitry 213 is deployed, embodiments of the present disclosure provide improvements over the conventional approaches mentioned above.

In a non-limiting example, an apparatus (e.g., the computing system 100 illustrated in FIG. 1, the voltage management circuitry 113/213/313 illustrated in FIG. 1, FIG. 2, and FIG. 3, the voltage regulation systems 201/301 illustrated in FIG. 2 and FIG. 3, and/or components thereof), includes a voltage regulator 252, voltage management circuitry 213, and a plurality of sensor circuits 260 coupled to the voltage management circuitry 213. Although embodiments are not so limited, the voltage regulator 252, the voltage management circuitry 213, and the plurality of sensor circuits 260 can be resident on, or otherwise comprise, a system-on-chip.

The voltage management circuitry 213 can receive signals indicative of a voltage or a current (and/or a change in a voltage or a change in a current) detected by one or more of the plurality of sensor circuits 260 and determine that at least one signal indicative of the voltage or the current detected by at least some of the plurality of sensor circuits 260 meets a criterion, although embodiments are not so limited and, in some embodiments, the voltage management circuitry 213 can receive signals indicative of a voltage or a current (and/or a change in a voltage or a change in a current) detected by each of the plurality of sensor circuits 260 and determine that at least one signal indicative of the voltage or the current detected by each of the plurality of sensor circuits 260 meets a criterion. In some embodiments, the plurality of sensor circuits 260 are coupled to respective circuit portion areas 256 coupled to the voltage regulator 252 and the voltage management circuit 213. In other embodiments, the plurality of sensor circuits 260 are resident on respective circuit portion areas 256 coupled to the voltage regulator 252 and the voltage management circuit 213.

As described herein, the signals indicative of the voltage or the current detected by each of the plurality of sensor circuits can correspond to a voltage drop and/or an IR drop experienced by at least one computing component 258 coupled to the voltage regulator 252 and/or to at least one circuit portion area 256 coupled to the voltage regulator 258. For example, the voltage management circuit 213 can be configured to determine that the at least one signal indicative of the voltage or the current detected by each of the plurality of sensor circuits 260 meets the criterion by determining that the at least one signal indicative of the voltage or the current detected by each of the plurality of sensor circuits 260 is indicative of a larger voltage drop (e.g., a "worst voltage drop") or a larger IR drop (e.g., a "worst IR drop") than other signals indicative of the voltage or the current detected by each of the plurality of sensor circuits 260. Accordingly, as described herein, the criterion can correspond to a worst voltage drop and/or a worst IR drop detected by at least one sensor circuit among the plurality of sensor circuits 260.

The voltage management circuitry 213 can generate a voltage management control signal in response to a determination that the at least one signal indicative of the voltage or the current detected by each of the plurality of sensor circuits 260 meets the criterion. The voltage management circuitry 213 can transfer (or cause transfer of) the voltage management control signal to the voltage regulator 252.

Upon receipt of the voltage management control signal, the voltage regulator 252 can generate a voltage signal in response to receipt of the signal generated in response to the determination that the at least one signal indicative of the voltage or the current detected by each of the plurality of sensor circuits 260 meets the criterion. The voltage signal can be a modified voltage signal, as described above. In some embodiments, the voltage regulator 252 can generate the voltage signal to provide voltage compensation (e.g., to remediate a voltage undershoot) or to provide voltage mitigation (e.g., to remediate a voltage overshoot) to at least one computing component 257 coupled to the voltage regulator 252 and/or to at least one circuit portion area 258 coupled to the voltage regulator 252.

Continuing with this non-limiting example, the voltage management circuitry 213 can be configured to generate the voltage management control signal by performing a logical operation involving each of the signals indicative of the voltage or the current detected by each of the plurality of sensor circuits 260. For example, the voltage management circuitry 213 can perform a logical OR operation as part of performing the logical operation involving each of the signals indicative of the voltage or the current detected by each of the plurality of sensor circuits 260, as described in more detail in connection with FIG. 3. Embodiments are not so limited, however, and the voltage management circuitry 213 can perform other logical operations (e.g., logical AND, logical NOR, logical XOR operations, etc.) to generate the voltage management control signal. Further, in some embodiments, the voltage management circuitry 213 can perform other operations, such as compare functions, greater than/less than functions, etc. to generate the voltage management control signal.

The apparatus can further include signal suppressing circuitry, such as an integrator (e.g., the integrator 354 illustrated in FIG. 3, herein), filter, or other such circuitry that is coupled to, or is resident on, the voltage regulator 252. In some embodiments, the signal suppressing circuitry is an integrator that can be configured to suppress signal fluctuations present in the voltage management control signal. For example, the integrator can output the integral of an input signal (e.g., the voltage management control signal) over a frequency range. By outputting the integral of the voltage management control signal, the integrator can allow for fluctuations (e.g., ripples) inherent in digital signals, such as the voltage management control signal, to be suppressed or otherwise mitigated. Embodiments are not limited to the use of an integrator and other circuitry (e.g., one or more filter circuits, etc.) that are operable to suppress signal fluctuations present in the voltage management control signal can be utilized.

Figure 3:
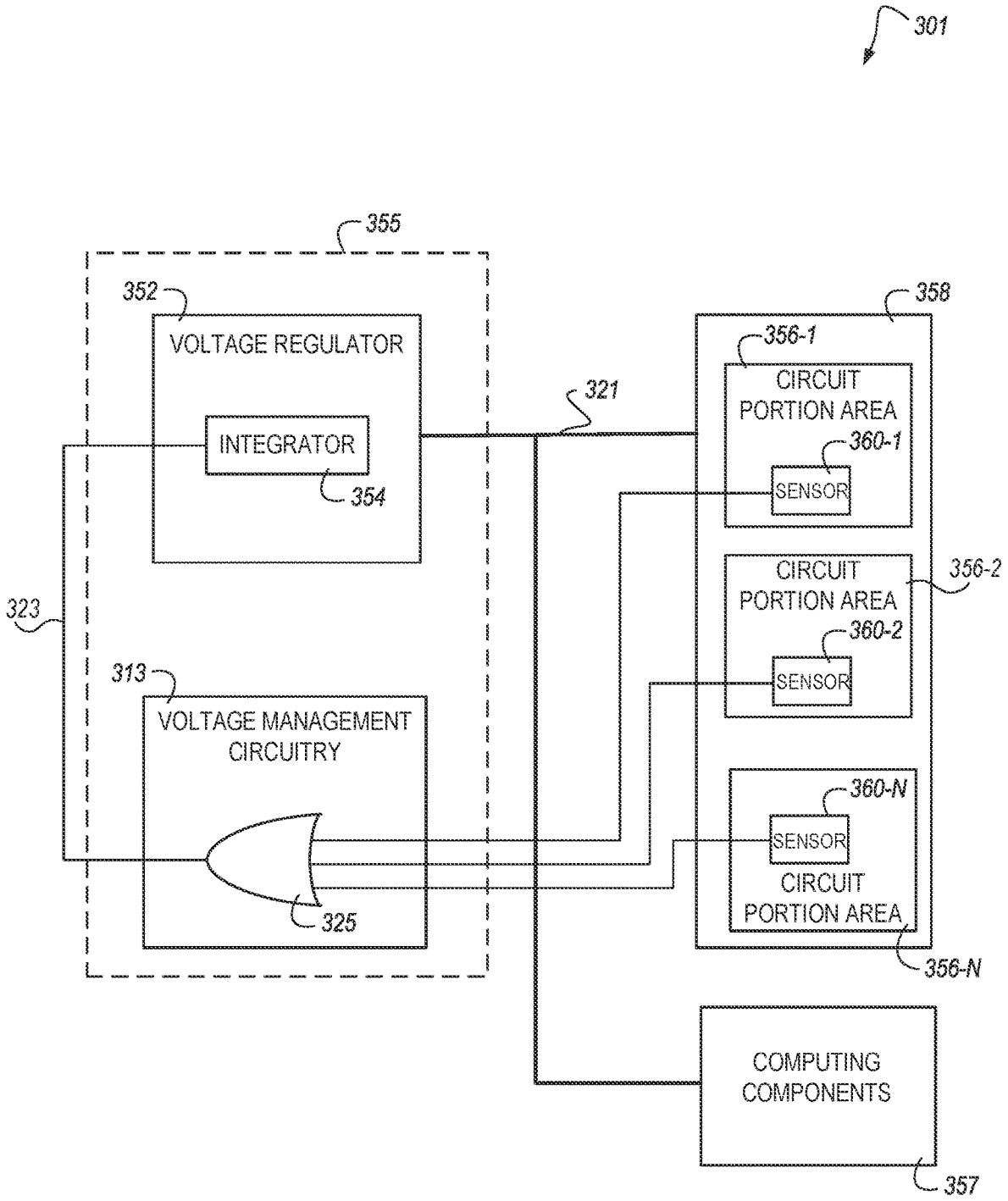
FIG. 3 illustrates another example of a voltage management system in accordance with some embodiments of the present disclosure.

FIG. 3 illustrates another example of a voltage management system 301 in accordance with some embodiments of the present disclosure. The example system 301, which can be referred to in the alternative as an "apparatus," includes voltage regulation circuitry 355, which includes a voltage regulator 352 and voltage management circuitry 313. As shown in FIG. 3, the voltage management circuitry 313 includes logic circuitry 325 in the form of a logical OR gate. Embodiments are not limited to inclusion of a logical OR gate, however, and the logic circuitry 325 can include other logical gates and/or other circuitry that is configured to determine characteristics of signals received from the sensor circuits 360 to, at minimum, determine a worst voltage drop and/or a worst IR drop associated with components of the circuit area 358 and/or the computing components 357.

In embodiments in which the logic circuitry 325 comprises a logical OR gate, information from each of the sensor circuits 360 is provided to the logical OR gate and a resultant output represents the input corresponding to the sensor circuit 360 that has detected the worst voltage drop or the worst IR drop in the voltage management system 301. As an example, when the logic circuitry 325 comprises a logical OR gate, the logic circuitry 325 can receive Boolean signals (e.g., signals having either a logical value of "1" or a logical value of "0") from the sensor circuits 360. These signals can correspond to whether a voltage (or current) detected by the sensor circuits 360 meets a threshold voltage (or current)

value. For example, a logical value of "1" can be generated by a sensor circuit 360 that detects a voltage that is below the threshold voltage value and a logical value of "0" can be generated by a sensor circuit 360 that detects a voltage that is above the threshold voltage value.

In other embodiments in which the logic circuitry 325 does not comprise a logical OR gate, the logic circuitry 325 can perform a compare operation to determine the input corresponding to the sensor circuit 360 that has detected the worst voltage drop or the worst IR drop in the voltage management system 301 and output signaling corresponding to the worst voltage drop or the worst IR drop in the voltage management system 301. Embodiments are not so limited, and other methodologies of comparing multiple signal inputs from the sensor circuits 360 using the logic circuitry 325 can be employed to determine the worst voltage drop or the worst IR drop in the voltage management system 301.

As shown in FIG. 3, The voltage regulator 352 includes an integrator 354. Although shown in FIG. 3 as being resident on the voltage regulator 352, the integrator 354 can, in some embodiments, be external to the voltage regulator 352 but coupled thereto. The output of the logic circuitry 325 is coupled to an input of the integrator 354 via a communication path 323. As discussed above, the integrator 354 can output the integral of an input signal (e.g., the voltage management control signal) over a frequency range. By outputting the integral of the voltage management control signal, the integrator can allow for fluctuations (e.g., ripples) inherent in digital signals, such as the voltage management control signal, to be suppressed or otherwise mitigated. This can allow for the voltage regulator 352 to apply a more accurate voltage signal (e.g., modified voltage signal) than if the voltage management control signal is not passed through the integrator 354. As mentioned above, embodiments are not limited to the use of an integrator 354 to suppress fluctuation in the signals received by the voltage regulator 352 and in some embodiments, signal suppression circuitry, such as one or more filter circuits can be utilized instead of an integrator 354 or in addition to the integrator 354. Then, no matter which or how many of the sensor circuits 360 generates the logical value of "1," (either only one of the sensor circuits 360 or multiple sensor circuits 360), the voltage regulator 352 receives, via the logic circuitry 325, a logical value of "1," which causes the output voltage of the voltage regulator 352 to be increased. Conversely, if all of the sensor circuits 360 in this example generate a logical value of "0," the voltage regulator 352 receives, via the logic circuitry 325, a logical value of "0," which causes the output voltage of the voltage regulator 352 to be decreased (e.g., to drift down).

Due to changes in the voltages (or currents) detected by the sensor circuits 360, the output of the voltage management circuitry 313 may oscillate due to the voltage (or current) detected by the sensor circuits 360 being slightly above or below the threshold(s). In some embodiments, signal suppression circuitry, such as the integrator 354 can be used to filter these oscillations, thereby allowing for the output of the voltage regulator 352 to expose a slow and low magnitude ripple around the threshold voltage on the output line 321.

In some embodiments, the voltage regulation circuitry 355 is coupled to a circuit area 358, which includes circuit area portions 356-1, 356-2 to 356-N (referred to generally herein as the circuit area portions 356). The circuit area portions 356 include sensor circuits 360-1, 360-2 to 360-N (referred to generally herein as the sensor circuits 360). The system 301 further includes computing components 357, which can be analogous to the computing components 257 illustrated in FIG. 2. In some embodiments, the voltage regulation circuitry 355, the voltage regulator 352, and voltage management circuitry 313 are analogous to the voltage regulation circuitry 255, the voltage regulator 252, and voltage management circuitry 213 illustrated in FIG. 2, Further, in some embodiments, the circuit area 358, the circuit area portions 358, and the sensor circuits 360 are analogous to the circuit area 258, the circuit area portions 258, and the sensor circuits 260 illustrated in FIG. 2.

As shown in FIG. 3, the system 301 includes a voltage signal line 321 (which can be analogous to the voltage signal line 221 illustrated in FIG. 2) coupling the voltage regulator 352 to the circuit area 355 and the computing components 357. The voltage signal line 321 be split into one or more voltage supply lines that can provide power to the circuit portion areas 356, the voltage sensors 360, and/or the computing components 357.

The system 301 further includes a number of circuit portion areas 356 (e.g., the circuit portion area 356-1, circuit portion area 356-2, to the circuit portion area 356-N) that have power supplied thereto via the voltage regulator 352 through the voltage signal line 321. The circuit portion areas 356 can be logic blocks that can include various hardware that form one or more cores (e.g., "intellectual property (IP) cores"). As used herein, a "core" or "IP core" generally refers to one or more blocks of data and/or logic that form constituent components of an application-specific integrated circuit or field-programmable gate array. The circuit portion areas 356 can be designed, built, and/or otherwise configured to perform specific tasks and/or functions within the systems described herein. As mentioned above, the computing components 357 can include controllers, memory devices, graphics processing units, processors/co-processors, and/or logic blocks, among others that are deployed on a memory sub-system (e.g., the memory sub-system 110 illustrated in FIG. 1, herein) in which the voltage management system 301 operates. In some embodiments, the voltage regulator 352 can take an action (or cause an action to be taken) to track, limit, adjust or manipulate the voltage signals applied to the voltage signal line 321 to control the voltage applied to the circuit portion areas 356 and/or to the computing component 357. As described herein, such action taken by the voltage regulator 352 is in response to signaling (e.g., a voltage management control signal) applied to the voltage regulator 352 by the voltage management circuitry 313.

As shown in FIG. 3, the circuit portion areas 356 can include sensor circuits 360. The sensor circuits 360 can include various hardware circuitry and/or circuitry components to detect voltage levels and/or current levels applied to the circuit portion areas 356 via the voltage signal line 321 and/or the voltage supply lines that are fed from the voltage signal line 321. The sensor circuits 360 can be configured to apply signaling indicative of a change in the current or the voltage, or both, associated with the voltage signal line 321 and/or the voltage supply lines 358 to the voltage management circuitry 313 in a similar manner as described above in connection FIG. 2. In response to receipt of such signaling, the voltage management circuitry 313 can determine characteristics of the received signaling and generate the voltage management control signal to cause the voltage regulator 352 to apply a modified voltage to the voltage signal line 321.

In a non-limiting example, a system (e.g., the computing system 100 illustrated in FIG. 1, the voltage management circuitry 113/213/313 illustrated in FIGS. 1-3, the voltage regulation circuitry 255/355 illustrated in FIG. 2 and FIG. 3, and/or the voltage management system 201/301 illustrated in FIG. 2 and FIG. 3, and/or components thereof), includes a plurality of circuit portion areas 360, a voltage regulator 352 coupled to the plurality of circuit portion areas 356, an integrator 354 is coupled to or is resident on the voltage regulator 352, and voltage management circuitry 313 is coupled to the voltage regulator 352 and to the plurality of circuit portion areas 356. As described above, the plurality of circuit portion areas 356 can include a controller, a processor, and/or a graphics processing unit, although embodiments are not so limited. Continuing with this non-limiting example, the system further includes a plurality of sensor circuits 360 that are coupled to, or resident on, the plurality of circuit portion areas 356. In some embodiments, the plurality of sensor circuits 360 are coupled to the voltage management circuit 313.

The voltage management circuit 313 can be configured to receive signals indicative of a voltage or a current detected by each of the plurality of sensor circuits 360 (or by a subset of sensor circuits among the plurality of sensor circuits 360) and determine that at least one signal indicative of the voltage or the current detected by the plurality of sensor circuits 360 (or by the subset of the plurality of sensor circuits 360) meets a criterion. The voltage management circuitry 313 can generate a voltage management control signal in response to a determination that the at least one signal indicative of the voltage or the current detected by the plurality of sensor circuits 360 (or by the subset of the plurality of sensor circuits 360) meets the criterion and transfer the voltage management control signal to the voltage regulator 352. The voltage regulator 352 can receive, via the integrator 354, the voltage management control signal, generate a voltage signal in response to receipt of the voltage management control signal and apply the generated voltage signal to the plurality of circuit portion areas 356. In some embodiments, the integrator 354 is configured to suppress signal fluctuations present in the voltage management control signal, as discussed above.

Continuing with this non-limiting example, the voltage management circuitry 313 can determine that the at least one signal indicative of the voltage or the current detected by each of the plurality of sensor circuits 360 (or by the subset of the plurality of sensor circuits 360) meets the criterion by determining that the at least one signal indicative of the voltage or the current detected by each of the plurality of sensor circuits 360 (or by the subset of the plurality of sensor circuits 360) is indicative of a larger voltage drop (e.g., a "worst voltage drop") or a larger IR drop (e.g., a "worst IR drop") than other signals indicative of the voltage or the current detected by each of the plurality of sensor circuits 360 (or by the subset of the plurality of sensor circuits 360). The voltage management circuitry 313 can then transfer the voltage management control signal to the voltage regulator 352 based on the determination that the at least one signal indicative of the voltage or the current detected by each of the plurality of sensor circuits 360 (or by the subset of the plurality of sensor circuits 360) is indicative of a larger voltage drop or a larger IR drop than other signals indicative of the voltage or the current detected by each of the plurality of sensor circuits 360 (or by the subset of the plurality of sensor circuits 360).

In some embodiments, the voltage management circuitry 313 can be configured to generate the voltage management control signal by performing a logical OR operation involving each of the signals indicative of the voltage or the current detected by each of the plurality of sensor circuits 360 (or by the subset of the plurality of sensor circuits 360). For example, the logic circuitry 325 of the voltage management circuitry 313 can be configured as a logical OR gate that performs a logical OR operation using the signals indicative of the voltage or the current detected by each of the plurality of sensor circuits 360 (or by the subset of the plurality of sensor circuits 360) as operands for logical OR operation to generate the voltage management control signal. As mentioned above, however, embodiments are not limited to performance of a logical OR operation to generate the voltage management control signal and other methodologies may be employed to generate the voltage management control signal.

Figure 4:
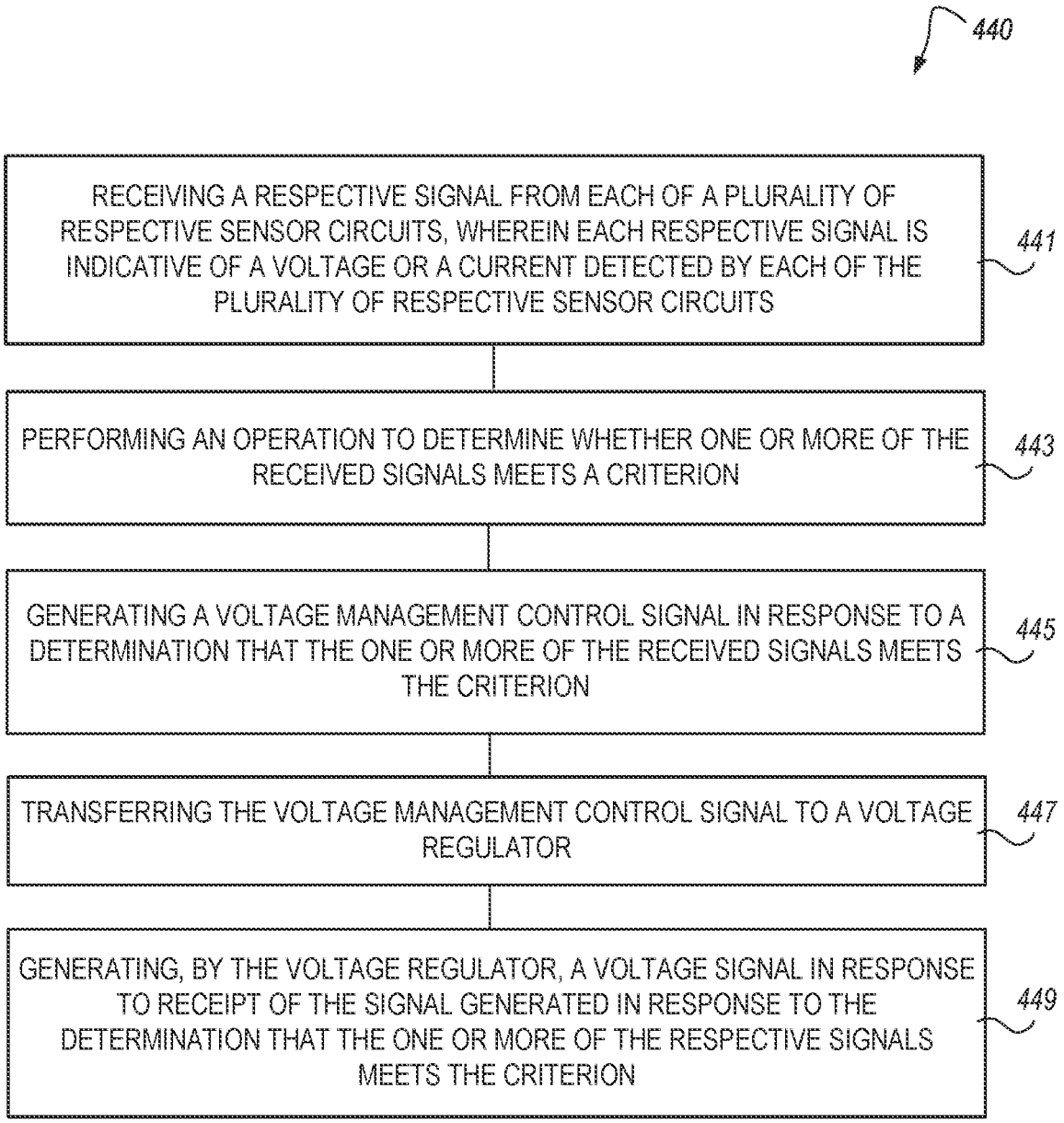
FIG. 4 is a flow diagram corresponding to a method for a voltage management system in accordance with some embodiments of the present disclosure.

FIG. 4 is a flow diagram corresponding to a method 440 for a voltage management system in accordance with some embodiments of the present disclosure. The method 440 can be performed by processing logic that can include hardware (e.g., processing device, circuitry, dedicated logic, programmable logic, microcode, hardware of a device, integrated circuit, etc.), software (e.g., instructions run or executed on a processing device), or a combination thereof. In some embodiments, the method 440 is performed by the voltage management circuitry 113 of FIG. 1. Although shown in a particular sequence or order, unless otherwise specified, the order of the processes can be modified. Thus, the illustrated embodiments should be understood only as examples, and the illustrated processes can be performed in a different order, and some processes can be performed in parallel. Additionally, one or more processes can be omitted in various embodiments. Thus, not all processes are required in every embodiment. Other process flows are possible.

At operation 441, the method 440 includes receiving a respective signal from each of a plurality of respective sensor circuits (e.g., the sensor circuits 260/350 illustrated in FIG. 2 and FIG. 3, herein) wherein each respective signal is indicative of a voltage or a current detected by each of the plurality of respective sensor circuits (or by a subset of the plurality of sensor circuits). In some embodiments, the respective signals are received by voltage management circuitry (e.g., the voltage management circuitry 113/213/313 illustrated in FIG. 1, FIG. 2, and FIG. 3, herein). The method 440 can include receiving the signals indicative of the voltage or the current detected by each of the plurality of respective sensor circuits (or by the subset of the plurality of sensor circuits) when said signals are indicative of a change in the voltage or a change in the current detected by each of the plurality of respective sensor circuits (or by the subset of the plurality of sensor circuits), although embodiments are not so limited and steady state voltages and/or currents may also be detected by the sensor circuits and transferred such that the respective signals are received, for example, by the voltage management circuitry.

For clarity, receiving respective signals from each of the plurality of respective sensor circuits is intended to mean that each sensor circuit (e.g., each respective sensor circuit) generates at least one signal (e.g., a respective signal) that is indicative of a voltage or a current detected by that respective sensor circuit. For example, if there are two sensor circuits, sensor circuit "A" and sensor circuit "B," sensor circuit "A" generates at least one signal indicative of a voltage or a current detected by sensor circuit "A" and sensor circuit "B" generates at least one signal indicative of a voltage or a current detected by sensor circuit "B." These signals are the received (e.g., by the voltage management circuitry 113/213/313 illustrated in FIG. 1, FIG. 2, and FIG. 3, herein) at operation 441 of the method 440.

At operation 443, the method 440 includes performing an operation to determine whether one or more of the received signals meets a criterion. In some embodiments, the criterion corresponds to a "worst voltage drop" and/or a "worst IR drop," as described herein. The operation to determine whether one or more of the received signals meets the criterion can be performed by the voltage management circuitry of FIG. 1, FIG. 2, and FIG. 3. In some embodiments, the operation to determine whether one or more of the received signals meets the criterion includes performing a logical operation using information corresponding to the one or more of the received signals as operands for the logical operation to determine whether the one or more of the received signals meets the criterion. However, embodiments are not so limited and the method 440 can include various other types of operations and/or methodologies to determine whether the one or more of the received signals meets the criterion.

At operation 445, the method 440 includes generating a voltage management control signal in response to a determination that the one or more of the received signals meets the criterion. In some embodiments, the method 440 includes determining that a particular signal of the one or more respective signals exhibits characteristics that fall below (e.g., are indicative of a "worst voltage drop" and/or a "worst IR drop") characteristics exhibited by other signals of the one or more respective signals and generating the voltage management control signal in response to the determination that the one or more of the respective signals meets the criterion based on characteristics exhibited by the particular signal.

At operation 447, the method 440 includes transferring the voltage management control signal to a voltage regulator (e.g., the voltage regulator 252/352 illustrated in FIG. 2 and FIG. 3, herein). In some embodiments, the method 440 includes suppressing, using signal suppressing circuitry (e.g., the integrator 354 illustrated in FIG. 3, herein), or other circuitry configured to suppress signal fluctuations, that is coupled to the voltage regulator, signal fluctuations present in the voltage management control signal. For example, as described above, the voltage management control signal can be passed through an integrator or other circuitry, such as one or more filter circuits, to mitigate ripple or other digital signal effects that may be present in the voltage management control signal.

At operation 449, the method 440 includes generating, by the voltage regulator, a voltage signal in response to receipt of the signal generated in response to the determination that the one or more of the respective signals meets the criterion. In some embodiments, the method 440 further includes generating, by the voltage regulator, the voltage signal to provide voltage compensation to at least one computing component (e.g., the computing components 257/357 illustrated in FIG. 2 and FIG. 3, herein) coupled to the voltage regulator and/or to at least one circuit portion area (e.g., the circuit portion areas 256/356 illustrated in FIG. 2 and FIG. 3, herein) coupled to the voltage regulator.

Figure 5:
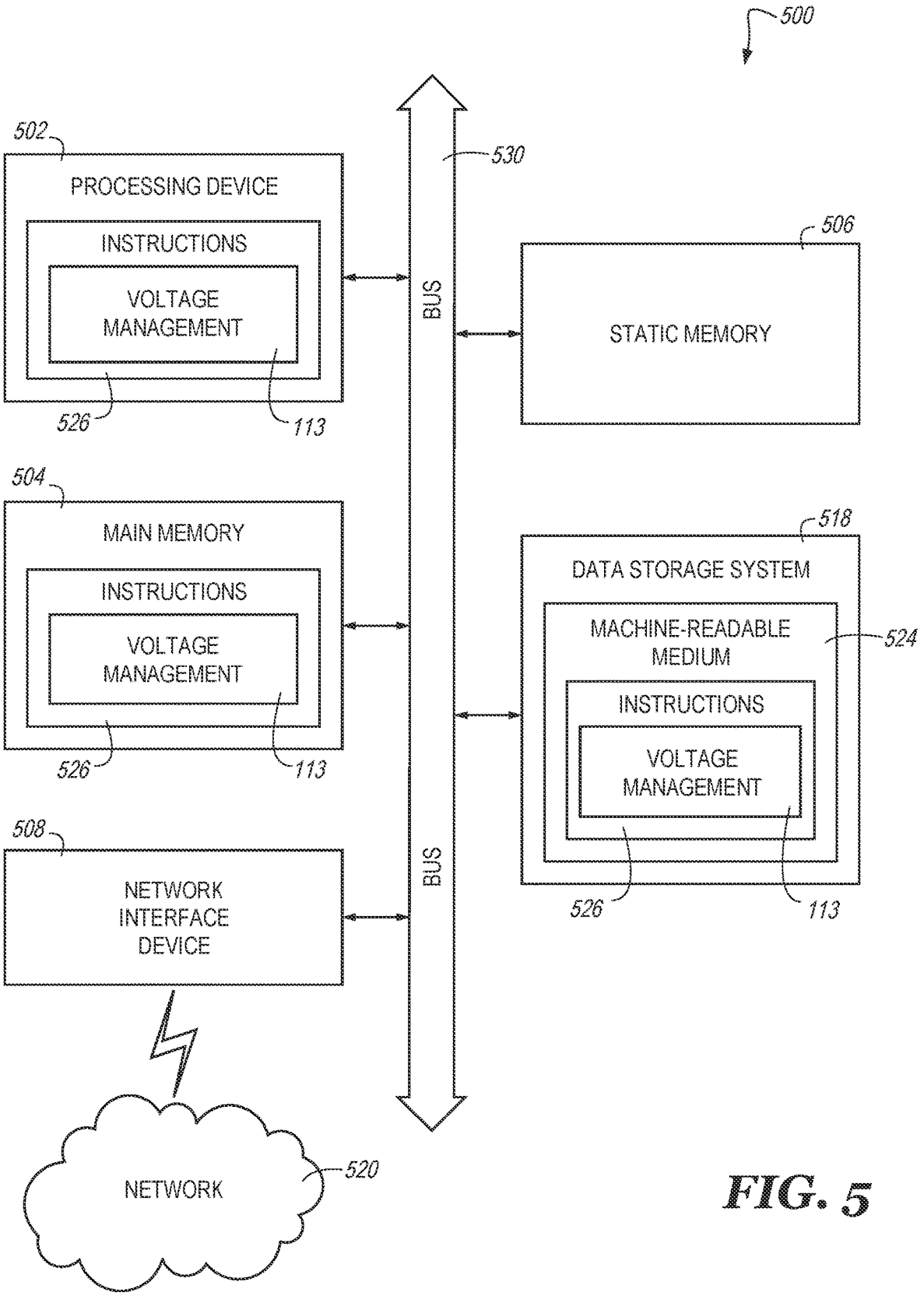
FIG. 5 is a block diagram of an example computer system in which embodiments of the present disclosure may operate.

FIG. 5 is a block diagram of an example computer system in which embodiments of the present disclosure may operate. For example, FIG. 5 illustrates an example machine of a computer system 500 within which a set of instructions, for causing the machine to perform any one or more of the methodologies discussed herein, can be executed. In some embodiments, the computer system 500 can correspond to a host system (e.g., the host system 120 of FIG. 1) that includes, is coupled to, or utilizes a memory sub-system (e.g., the memory sub-system 110 of FIG. 1) or can be used to perform the operations of a controller (e.g., to execute an operating system to perform operations corresponding to the voltage management circuitry 113 of FIG. 1). In alternative embodiments, the machine can be connected (e.g., networked) to other machines in a LAN, an intranet, an extranet, and/or the Internet. The machine can operate in the capacity of a server or a client machine in client-server network environment, as a peer machine in a peer-to-peer (or distributed) network environment, or as a server or a client machine in a cloud computing infrastructure or environment.

The machine can be a personal computer (PC), a tablet PC, a set-top box (STB), a Personal Digital Assistant (PDA), a cellular telephone, a web appliance, a server, a network router, a switch or bridge, or any machine capable of executing a set of instructions (sequential or otherwise) that specify actions to be taken by that machine. Further, while a single machine is illustrated, the term "machine" shall also be taken to include any collection of machines that individually or jointly execute a set (or multiple sets) of instructions to perform any one or more of the methodologies discussed herein.

The example computer system 500 includes a processing device 502, a main memory 504 (e.g., read-only memory (ROM), flash memory, dynamic random access memory (DRAM) such as synchronous DRAM (SDRAM) or Rambus DRAM (RDRAM), etc.), a static memory 506 (e.g., flash memory, static random access memory (SRAM), etc.), and a data storage system 518, which communicate with each other via a bus 530.

The processing device 502 represents one or more general-purpose processing devices such as a microprocessor, a central processing unit, or the like. More particularly, the processing device can be a complex instruction set computing (CISC) microprocessor, reduced instruction set computing (RISC) microprocessor, very long instruction word (VLIW) microprocessor, or a processor implementing other instruction sets, or processors implementing a combination of instruction sets. The processing device 502 can also be one or more special-purpose processing devices such as an application specific integrated circuit (ASIC), a field programmable gate array (FPGA), a digital signal processor (DSP), network processor, or the like. The processing device 502 is configured to execute instructions 526 for performing the operations and steps discussed herein. The computer system 500 can further include a network interface device 508 to communicate over the network 520.

The data storage system 518 can include a machine-readable storage medium 524 (also known as a computer-readable medium) on which is stored one or more sets of instructions 526 or software embodying any one or more of the methodologies or functions described herein. The instructions 526 can also reside, completely or at least partially, within the main memory 504 and/or within the processing device 502 during execution thereof by the computer system 500, the main memory 504 and the processing device 502 also constituting machine-readable storage media. The machine-readable storage medium 524, data storage system 518, and/or main memory 504 can correspond to the memory sub-system 110 of FIG. 1.

In one embodiment, the instructions 526 include instructions to implement functionality corresponding to voltage management circuitry (e.g., the voltage management circuitry 113 of FIG. 1). While the machine-readable storage medium 524 is shown in an example embodiment to be a single medium, the term "machine-readable storage medium" should be taken to include a single medium or multiple media that store the one or more sets of instructions. The term "machine-readable storage medium" shall also be taken to include any medium that is capable of storing or encoding a set of instructions for execution by the machine and that cause the machine to perform any one or more of the methodologies of the present disclosure. The term "machine-readable storage medium" shall accordingly be taken to include, but not be limited to, solid-state memories, optical media, and magnetic media.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities. Usually, though not necessarily, these quantities take the form of electrical or magnetic signals capable of being stored, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. The present disclosure can refer to the action and processes of a computer system, or similar electronic computing device, that manipulates and transforms data represented as physical (electronic) quantities within the computer system's registers and memories into other data similarly represented as physical quantities within the computer system memories or registers or other such information storage systems.

The present disclosure also relates to an apparatus for performing the operations herein. This apparatus can be specially constructed for the intended purposes, or it can include a general purpose computer selectively activated or reconfigured by a computer program stored in the computer. Such a computer program can be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, each coupled to a computer system bus.

The algorithms and displays presented herein are not inherently related to any particular computer or other apparatus. Various general purpose systems can be used with programs in accordance with the teachings herein, or it can prove convenient to construct a more specialized apparatus to perform the method. The structure for a variety of these systems will appear as set forth in the description below. In addition, the present disclosure is not described with reference to any particular programming language. It will be appreciated that a variety of programming languages can be used to implement the teachings of the disclosure as described herein.

The present disclosure can be provided as a computer program product, or software, that can include a machine-readable medium having stored thereon instructions, which can be used to program a computer system (or other electronic devices) to perform a process according to the present disclosure. A machine-readable medium includes any mechanism for storing information in a form readable by a machine (e.g., a computer). In some embodiments, a machine-readable (e.g., computer-readable) medium includes a machine (e.g., a computer) readable storage medium such as a read only memory ("ROM"), random access memory ("RAM"), magnetic disk storage media, optical storage media, flash memory devices, etc.

In the foregoing specification, embodiments of the disclosure have been described with reference to specific example embodiments thereof. It will be evident that various modifications can be made thereto without departing from the broader spirit and scope of embodiments of the disclosure as set forth in the following claims. The specification and drawings are, accordingly, to be regarded in an illustrative sense rather than a restrictive sense.

What is claimed is:

1. A method, comprising:

receiving a respective signal from each of a plurality of respective sensor circuits, wherein each respective signal is indicative of a voltage or a current detected by each of the plurality of respective sensor circuits;

performing a logical OR operation on the respective signal from each of the plurality of respective sensor circuits to determine whether one or more of the received signals meet a criterion;

generating a voltage management control signal in response to a determination that the one or more of the received signals meets the criterion;

transferring the voltage management control signal to a voltage regulator; and generating, by the voltage regulator, a voltage signal in response to receipt of the voltage management control signal, wherein the generating includes using an integrator to suppress signal fluctuations present in the voltage management control signal.

2. The method of claim 1, wherein the voltage signal provides voltage compensation to at least one computing component coupled to the voltage regulator or to at least one circuit portion area coupled to the voltage regulator, or both.

3. The method of claim 1, wherein the integrator outputs an integral of the voltage management control signal over a frequency range.

4. The method of claim 1, wherein the logical OR operation is performed using information corresponding to the one or more of the received signals as operands for the logical OR operation to determine whether the one or more of the received signals meets the criterion.

5. The method of claim 1, further comprising receiving the signals indicative of the voltage or the current detected by each of the plurality of respective sensor circuits when said signals are indicative of a change in the voltage or a change in the current detected by each of the plurality of respective sensor circuits.

6. The method of claim 1, further comprising:

determining that a particular signal of the one or more respective signals exhibits characteristics that fall below characteristics exhibited by other signals of the one or more respective signals; and generating the voltage management control signal in response to the determination that the one or more of the respective signals meets the criterion based on characteristics exhibited by the particular signal.

7. An apparatus, comprising:

a voltage regulator;

voltage management circuitry; and a plurality of sensor circuits coupled to the voltage management circuitry, wherein the voltage management circuitry is configured to:

receive signals indicative of a voltage or a current detected by sensor circuits among the plurality of sensor circuits;

perform a logical OR operation on the received signals to determine whether one or more of the received signals meet a criterion;

generate a voltage management control signal in response to a determination that the at least one signal indicative of the voltage or the current detected by the sensor circuits among the plurality of sensor circuits meets the criterion; and transfer the voltage management control signal to the voltage regulator, and wherein:

the voltage regulator is configured to generate a voltage signal in response to receipt of the voltage management control signal, wherein the voltage regulator integrates the voltage management control signal to suppress signal fluctuations present in the voltage management control signal.

8. The apparatus of claim 7, wherein each of the received signals that meets the criterion includes a larger voltage drop or current drop than other signals indicative of the voltage or the current detected by each of the plurality of sensor circuits.

9. The apparatus of claim 8, wherein the voltage regulator integrates a plurality of detected worst voltage drops to suppress the signal fluctuations present in the voltage management circuitry.

10. The apparatus of claim 7, wherein the voltage regulator is configured to generate the voltage signal to provide voltage compensation to at least one computing component coupled to the voltage regulator or to at least one circuit portion area coupled to the voltage regulator, or both.

11. The apparatus of claim 7, wherein the integrator is configured to output an integral of the voltage management control signal over a frequency range.

12. The apparatus of claim 7, wherein signals among the signals indicative of the voltage or the current detected by the sensor circuits among the plurality of sensor circuits correspond to a voltage drop or an IR drop, or both, experienced by at least one computing component coupled to the voltage regulator or to at least one circuit portion area coupled to the voltage regulator, or both.

13. The apparatus of claim 7, wherein the plurality of sensor circuits are resident on respective circuit portion areas coupled to the voltage regulator and the voltage management circuit.

14. The apparatus of claim 7, wherein the voltage management circuit is further configured to determine that the at least one signal indicative of the voltage or the current detected by the sensor circuits among the plurality of sensor circuits meets the criterion by determining that the at least one signal indicative of the voltage or the current detected by the sensor circuits among the plurality of sensor circuits is indicative of a larger voltage drop or a larger IR drop than other signals indicative of the voltage or the current detected by the sensor circuits among the plurality of sensor circuits.

15. The apparatus of claim 7, wherein the voltage regulator, the voltage management circuitry, and the plurality of sensor circuits comprise a system-on-chip.

16. A system, comprising:

a plurality of circuit portion areas;

a voltage regulator coupled to the plurality of circuit portion areas;

signal suppressing circuitry coupled to the voltage regulator;

voltage management circuitry coupled to the voltage regulator and to the plurality of circuit portion areas; and a plurality of sensor circuits coupled to the plurality of circuit portion areas, the plurality of sensor circuits being coupled to the voltage management circuitry, wherein the voltage management circuitry is configured to:

receive, to a logic gate of the voltage management circuitry, signals indicative of a voltage or a current detected by each of the plurality of sensor circuits;

perform a logical operation on the received signals to determine whether one or more of the received signals meet a criterion;

generate a voltage management control signal indicating whether the at least one signal indicative of the voltage or the current detected by each of the plurality of sensor circuits meets the criterion; and provide the voltage management control signal from an output of the logic gate to the voltage regulator, and wherein the voltage regulator is configured to:

receive, via the signal suppressing circuitry, the voltage management control signal;

generate a voltage signal in response to receipt of the voltage management control signal; and apply the generated voltage signal to the plurality of circuit portion areas, and wherein the signal suppressing circuitry integrates the voltage management control signal to suppress signal fluctuations present in the voltage management control signal.

17. The system of claim 16, wherein the logic gate is a logical OR gate.

18. The system of claim 16, wherein the signal suppressing circuitry comprises an integrator that is configured to output an integral of the voltage management control signal over a frequency range.

19. The system of claim 16, wherein the voltage management circuitry is further configured to:

determine that the at least one signal indicative of the voltage or the current detected by each of the plurality of sensor circuits meets the criterion by determining that the at least one signal indicative of the voltage or the current detected by each of the plurality of sensor circuits is indicative of a larger voltage drop or a larger IR drop than other signals indicative of the voltage or the current detected by each of the plurality of sensor circuits; and transfer the voltage management control signal to the voltage regulator based on the determination that the at least one signal indicative of the voltage or the current detected by each of the plurality of sensor circuits is indicative of a larger voltage drop or a larger IR drop than other signals indicative of the voltage or the current detected by each of the plurality of sensor circuits.

20. The system of claim 16, wherein the signal suppressing circuitry integrates a plurality of detected worst voltage drops to suppress the signal fluctuations present in the voltage management control signal.

* * * * *